US011421370B2

(12) United States Patent
Wright et al.

(10) Patent No.: US 11,421,370 B2
(45) Date of Patent: Aug. 23, 2022

(54) WASHING MACHINE APPLIANCE LOCK AND LIGHT

(71) Applicant: Haier US Appliance Solutions, Inc., Wilmington, DE (US)

(72) Inventors: Troy Marshall Wright, Louisville, KY (US); Peter Hans Bensel, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 204 days.

(21) Appl. No.: 16/744,542

(22) Filed: Jan. 16, 2020

(65) Prior Publication Data

US 2021/0222348 A1 Jul. 22, 2021

(51) Int. Cl.

| | |
|---|---|
| ***D06F 39/14*** | (2006.01) |
| ***D06F 34/10*** | (2020.01) |
| ***D06F 103/40*** | (2020.01) |

(52) U.S. Cl.

CPC ..... *D06F 39/14* (2013.01); *D06F 34/10* (2020.02); *D06F 2103/40* (2020.02)

(58) Field of Classification Search

CPC ..... D06F 39/14

See application file for complete search history.

(56) References Cited

U.S. PATENT DOCUMENTS

| | | | | |
|---|---|---|---|---|
| 6,036,241 | A * | 3/2000 | Ostdiek | D06F 37/42 292/229 |
| 8,016,444 | B2 | 9/2011 | Cho et al. | |
| 2009/0153057 | A1* | 6/2009 | Cho | F21V 21/00 315/76 |
| 2013/0314897 | A1* | 11/2013 | Dal Ben | D06F 34/22 362/91 |
| 2021/0203218 | A1* | 7/2021 | Park | H02K 1/274 |

FOREIGN PATENT DOCUMENTS

| | | |
|---|---|---|
| CN | 203159957 U | 8/2013 |
| JP | 2002292188 A | 10/2002 |

* cited by examiner

*Primary Examiner* — Spencer E. Bell
(74) *Attorney, Agent, or Firm* — Dority & Manning, P.A.

(57) ABSTRACT

A washing machine appliance includes a cabinet, a tub positioned within the cabinet, and a basket rotatably mounted within the tub. The basket defines a wash chamber for receipt of articles for washing. The basket is positioned proximate an aperture in the cabinet and, as a result of such positioning, the wash chamber is accessible through the aperture. A door is rotatably mounted to the cabinet. A lock is configured to engage the door and prevent the door from rotating when the door is closed and the lock is locked. A light is mounted to the lock and the light is positioned and oriented to illuminate the wash chamber.

18 Claims, 8 Drawing Sheets

WASHING MACHINE APPLIANCE LOCK AND LIGHT

FIELD OF THE INVENTION

The present disclosure relates generally to washing machine appliances, and more particularly to lid locks and lights for washing machine appliances.

BACKGROUND OF THE INVENTION

Washing machine appliances generally include a tub for containing wash fluid, e.g., water and detergent, bleach, and/or other fluid additives. A basket is rotatably mounted within the tub and defines a wash chamber for receipt of articles for washing. During operation of such washing machine appliances, wash fluid is directed into the tub and onto articles within the wash chamber of the basket. The basket and/or an agitation element can rotate at various speeds to, e.g., agitate articles within the wash chamber, wring wash fluid from articles within the wash chamber, etc.

During loading and unloading of the washing machine appliance, a user reaches into the wash chamber to add or remove items therefrom. As the wash chamber is an internal component of the washing machine appliance, some portions of the wash chamber may be difficult to see, for example if they are obscured or shadowed by other parts of the washing machine appliance.

Accordingly, a washing machine appliance including one or more features for improved visibility of internal components such as the wash chamber would be useful. Further, a washing machine appliance including one more features for illuminating the wash chamber without requiring additional wiring or electrical connections would be beneficial.

BRIEF DESCRIPTION OF THE INVENTION

Aspects and advantages of the invention are set forth below in the following description, or may be obvious from the description, or may be learned through practice of the invention.

In accordance with one embodiment of the present disclosure, a washing machine appliance is provided. The washing machine appliance includes a cabinet. The cabinet defines a vertical direction, a lateral direction, and a transverse direction. The vertical direction, the lateral direction, and the transverse direction are mutually perpendicular. A tub is positioned within the cabinet. A basket is rotatably mounted within the tub. The basket defines a wash chamber for receipt of articles for washing. The basket is positioned proximate an aperture in the cabinet so that the wash chamber is accessible through the aperture. The washing machine appliance further includes a door rotatably mounted to the cabinet. The door is selectively rotatable between a closed position where the door inhibits access to the wash chamber and an open position which permits access to the wash chamber through the aperture. The washing machine appliance also includes a lock configured to engage the door and prevent the door from rotating to the open position when the door is in the closed position and the lock is in a locked position. A light is mounted to the lock. The light includes a housing and a lens on an oblique face of the housing. The lens is positioned and oriented to illuminate the wash chamber. The oblique face of the housing is oblique to at least two of the vertical direction, the lateral direction, and the transverse direction.

In accordance with another embodiment of the present disclosure, a washing machine appliance is provided. The washing machine appliance includes a cabinet and a tub positioned within the cabinet. A basket is rotatably mounted within the tub. The basket defines a wash chamber for receipt of articles for washing. The basket is positioned proximate an aperture in the cabinet so that the wash chamber is accessible through the aperture. The washing machine appliance further includes a door rotatably mounted to the cabinet. The door is selectively rotatable between a closed position where the door inhibits access to the wash chamber and an open position which permits access to the wash chamber through the aperture. The washing machine appliance also includes a lock configured to engage the door and prevent the door from rotating to the open position when the door is in the closed position and the lock is in a locked position. A light is mounted to the lock. The light is positioned and oriented to illuminate the wash chamber.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
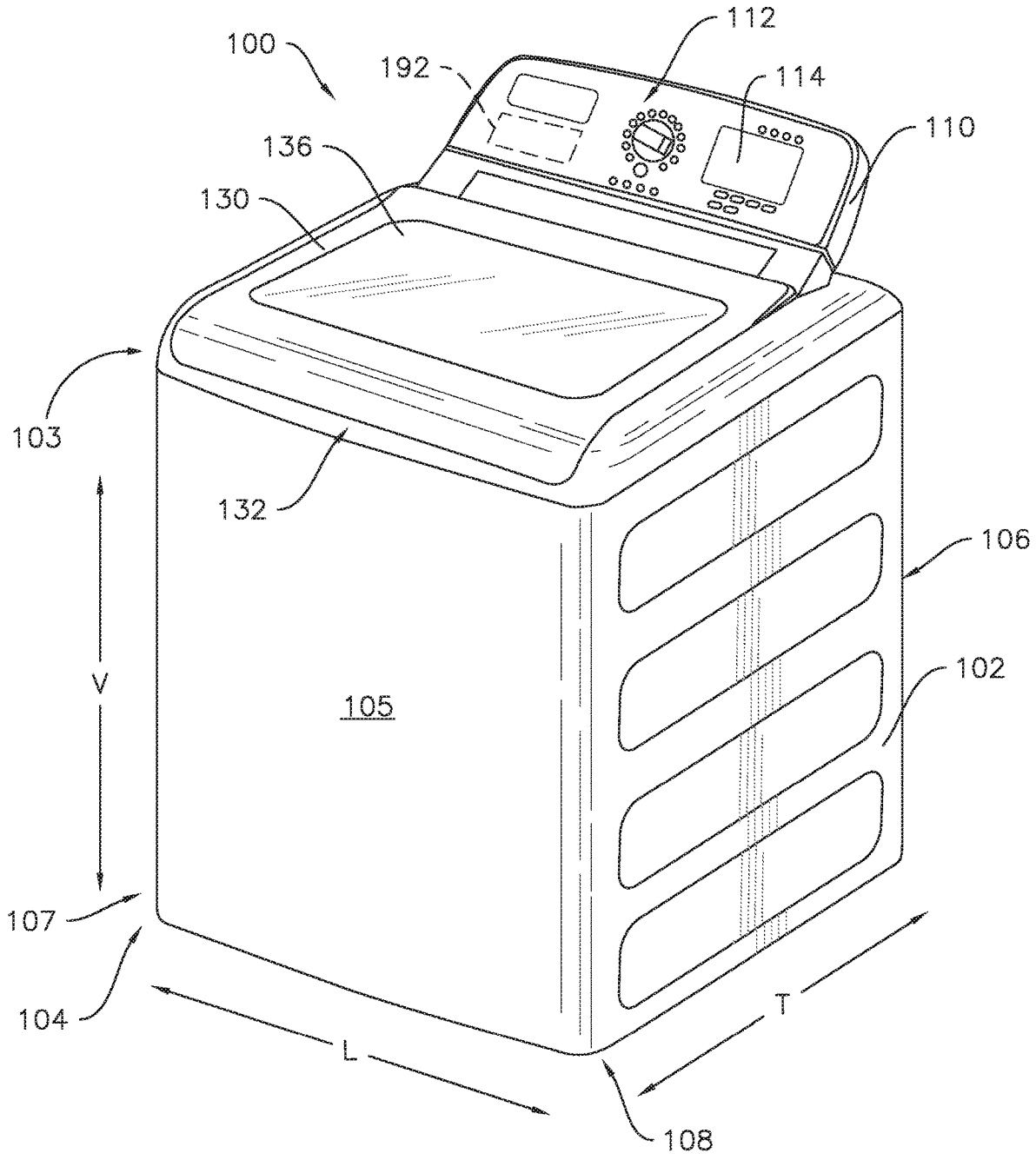
FIG. 1 provides a perspective view of an exemplary washing machine appliance that may incorporate various embodiments of the present subject matter with a door or lid of the washing machine appliance shown in a closed position.

Reference now will be made in detail to embodiments of the invention, one or more examples of which are illustrated in the drawings. Each example is provided by way of explanation of the invention, not limitation of the invention.

In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

Repeat use of reference characters in the present specification and drawings is intended to represent the same or analogous features or elements of the present disclosure.

In order to aid understanding of this disclosure, several terms are defined below. The defined terms are understood to have meanings commonly recognized by persons of ordinary skill in the arts relevant to the present invention. The terms "includes" and "including" are intended to be inclusive in a manner similar to the term "comprising." Similarly, the term "or" is generally intended to be inclusive (i.e., "A or B" is intended to mean "A or B or both"). Terms such as "first," "second," and "third," etc. may be used interchangeably to distinguish one element from another and are not intended to signify location or importance of the individual elements. Furthermore, it should be appreciated that as used herein, terms of approximation, such as "approximately," "substantially," or "about," refer to being within a ten percent margin of error. When used in the context of an angle or direction, such terms include within ten degrees greater or less than the stated angle or direction. For example, "generally vertical" includes directions within ten degrees of vertical in any direction, e.g., clockwise or counter-clockwise.

Figure 2:
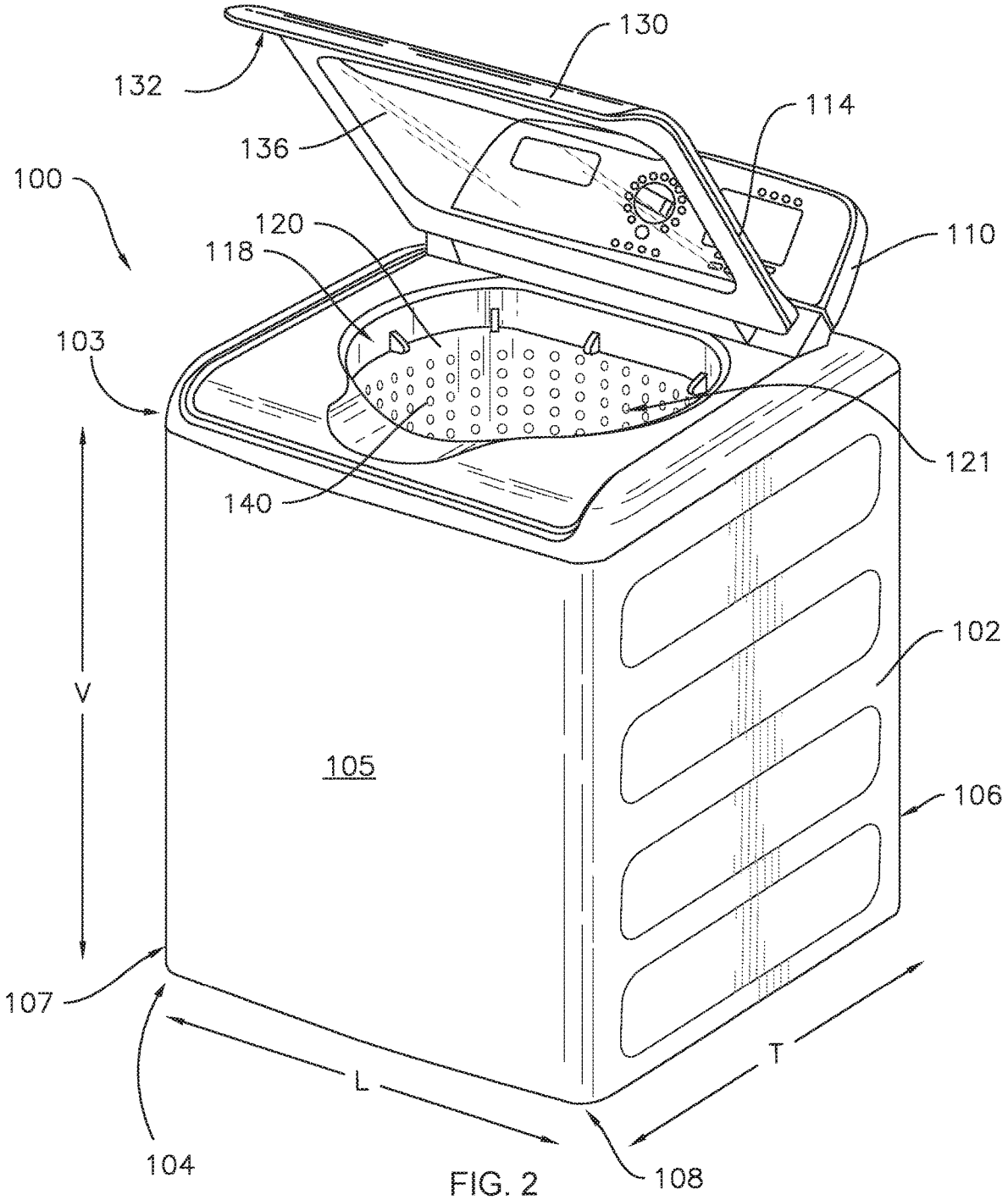
FIG. 2 provides a perspective view of the exemplary washing machine appliance of FIG. 1 with the door or lid of the washing machine appliance shown in an open position.
Figure 3:
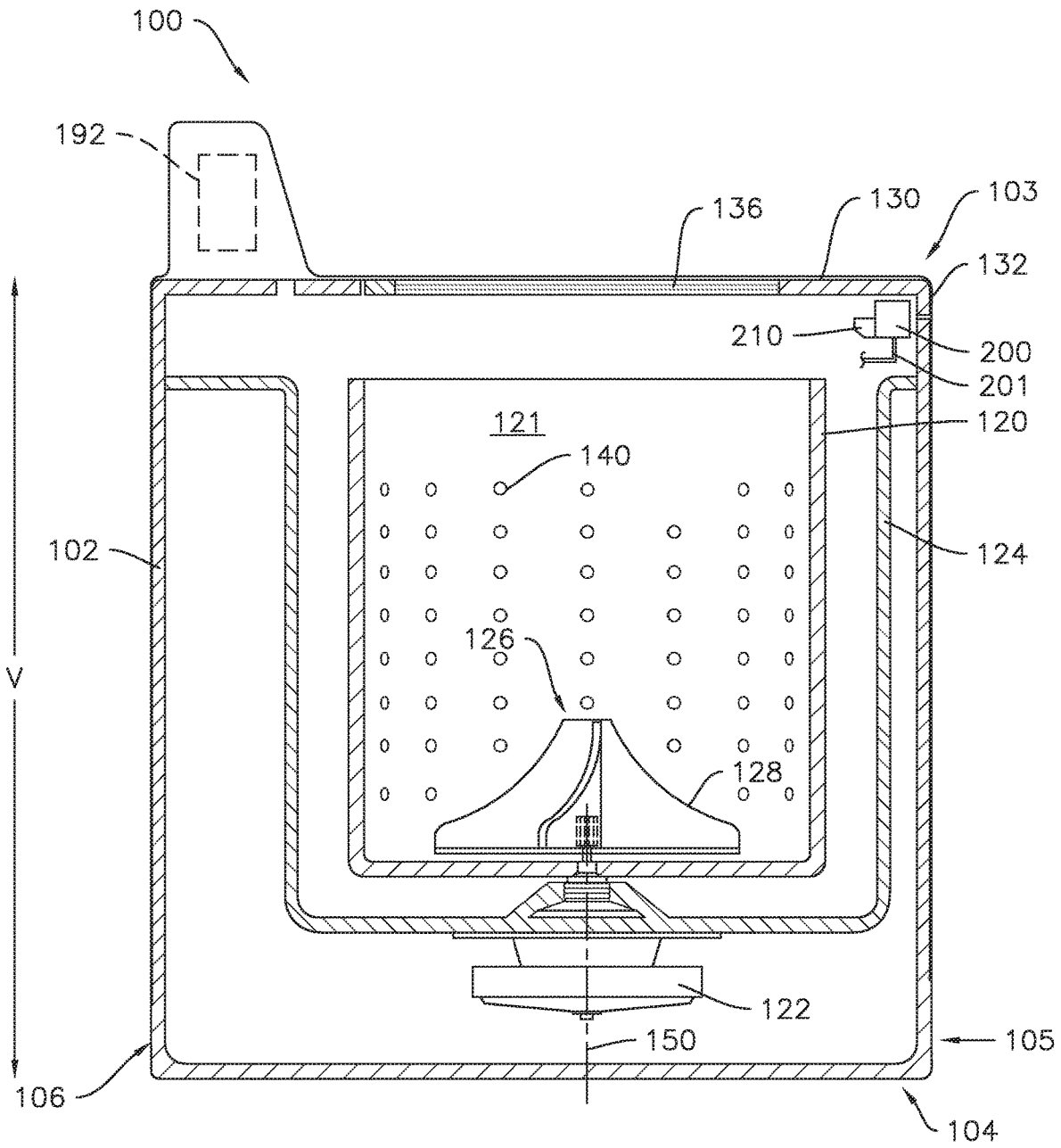
FIG. 3 provides a side section view of the exemplary washing machine appliance of FIG. 1.

FIGS. 1 and 2 illustrate perspective views of an exemplary embodiment of a vertical axis washing machine appliance 100. FIG. 3 illustrates a section view of the exemplary washing machine appliance 100. In FIG. 1, a lid or door 130 is shown in a closed position. In FIG. 2, the door 130 is shown in an open position. While described in the context of a specific embodiment of vertical axis washing machine appliance 100, it will be understood that vertical axis washing machine appliance 100 is provided by way of example only. Other washing machine appliances having different configurations, different appearances, and/or different features may also be utilized with the present subject matter as well, e.g., horizontal axis washing machines.

Washing machine appliance 100 defines a lateral direction L, a transverse direction T, and a vertical direction V. The lateral direction L, transverse direction T, and vertical direction V are mutually perpendicular and define an orthogonal coordinate system. As shown, washing machine appliance 100 has a cabinet 102 which extends between a top 103 and a bottom 104 along the vertical direction V. The cabinet 102 also extends between a front side 105 and a rear side 106 along the transverse direction T and between a left side 107 and a right side 108 along the lateral direction L. As used herein, terms such as "left," "right," "front," "back," "top," or "bottom" are used with reference to the perspective of a user accessing the washing machine appliance 100. For example, a user stands in front of the washing machine appliance 100 (such that the user is facing the front side 105 and the front side 105 is nearest the user, with the right side 108 on the user's right, etc.) to open the door 130 and reach into the wash chamber 121 to access items therein.

As generally seen in FIGS. 2 and 3, a wash basket 120 is rotatably mounted within cabinet 102. For example, a wash tub 124 may be mounted within the cabinet 102, and the wash basket 120 may be rotatably mounted within the wash tub 124. A motor 122 may be provided in mechanical communication with wash basket 120 in order to selectively rotate wash basket 120 (e.g., during an agitation or a rinse cycle of washing machine appliance 100). Wash basket 120 defines a wash chamber 121 that is configured for receipt of articles for washing. An agitator or impeller 126 extends from wash basket 120 into wash chamber 121 to assist agitation of articles disposed within wash chamber 121 during operation of washing machine appliance 100.

Cabinet 102 of washing machine appliance 100 has an aperture 118 (FIG. 2) that permits user access to wash chamber 121 of wash basket 120. In the illustrated example, the aperture 118 is defined in a top panel of the cabinet 102, however, this is by way of example only, the aperture 118 may also be defined, e.g., in a front panel of the cabinet 102. Door 130 is rotatably mounted to cabinet 102. Door 130 selectively rotates between the closed position shown in FIG. 1 and the open position shown in FIG. 2. In the closed position, door 130 inhibits access to wash chamber 121. Conversely, in the open position, a user can access wash chamber 121. A window 136 in door 130 permits viewing of wash chamber 121 when door 130 is in the closed position, e.g., during operation of washing machine appliance 100. Door 130 also includes a handle 132 that, e.g., a user may pull and/or lift when opening and closing door 130.

A control panel 110 with a plurality of input selectors 112 (FIG. 1) extends from the cabinet 102. Control panel 110 and input selectors 112 collectively form a user interface for operator selection of machine cycles and features. A display 114 of control panel 130 may indicate selected features, a countdown timer, and/or other items of interest to appliance users.

FIG. 3 provides a side section view of the exemplary washing machine appliance 100. As shown in FIG. 3, the washing machine appliance 100 may include a tub 124 non-rotatably mounted within the cabinet 102 and a wash basket 120 rotatably mounted within the tub 124. A motor 122, e.g., such as a pancake motor, is in mechanical communication with wash basket 120 to selectively rotate wash basket 120 and/or an agitator feature positioned therein (e.g., during an agitation or a rinse cycle of washing machine appliance 100). Wash basket 120 may define one or more agitator features such as an impeller to assist in agitation and cleaning of articles disposed within wash basket 120 during operation of washing machine appliance 100. For example, as illustrated in FIG. 3, an agitator element 126 includes a plurality of ribs 128 which extend within basket 120. Wash basket 120 may also define a plurality of perforations 140 in order to facilitate fluid communication between an interior, e.g., wash chamber 121, of basket 120 and the wash tub 124. In particular, in the example embodiment illustrated herein, basket 120 is rotatable about a central axis 150 and the central axis 150 may be oriented generally along or parallel to the vertical direction V. Accordingly, the washing machine appliance 100 may be referred to as a vertical axis washing machine. As mentioned above, the illustrated vertical axis washing machine 100 is provided by way of example only. Embodiments of the present disclosure may also include, e.g., a horizontal axis washing machine as is generally understood in the art.

Operation of washing machine appliance 100 is controlled by a controller or processing device 192 that is operatively coupled to control panel 110 for user manipulation to select washing machine cycles and features. In response to user manipulation of control panel 110, the controller 192 operates the various components of washing machine appliance 100 to execute selected machine cycles and features. Controller 192 may further be operatively coupled to various other components of appliance 100, such as various valves, one or more sensors such as a pressure sensor, a speed sensor, temperature sensors, and/or other suitable sensors, etc.

Controller 192 may include a memory and microprocessor, such as a general or special purpose microprocessor operable to execute programming instructions or micro-control code associated with a cleaning cycle. The memory may represent random access memory such as DRAM, or read only memory such as ROM or FLASH. In one embodiment, the processor executes programming instructions stored in memory. The memory may be a separate component from the processor or may be included onboard within the processor. Alternatively, controller 192 may be constructed without using a microprocessor, e.g., using a combination of discrete analog and/or digital logic circuitry (such as switches, amplifiers, integrators, comparators, flip-flops, AND gates, and the like) to perform control functionality instead of relying upon software. Control panel 110 and other components of washing machine appliance 100 may be in communication with controller 192 via one or more signal lines or shared communication busses.

In an illustrative embodiment, laundry items may be loaded into wash chamber 121 through aperture 118, and washing operation may be initiated through operator manipulation of input selectors 112. Wash basket 120 (and/or the wash tub 124) may be filled with water and detergent to form a wash fluid. One or more valves can be controlled by washing machine appliance 100 to provide for filling wash basket 120 to the appropriate level for the amount of articles being washed. Once wash basket 120 is properly filled with fluid, the contents of wash chamber 121 are agitated for cleansing of laundry items in wash basket 120. For example, the agitation element 126 and/or basket 120 may be moved back and forth in an oscillatory motion.

After the agitation phase of the wash cycle is completed, wash basket 120 may be drained. Laundry articles can then be rinsed by again adding fluid to wash basket 120 and, depending on the particulars of the cleaning cycle selected by a user, the agitation element or impeller may again provide agitation within wash chamber 121. One or more spin cycles may also be used. In particular, a spin cycle may be applied after the wash cycle and/or after the rinse cycle in order to wring wash fluid from the articles being washed. During a spin cycle, wash basket 120 is rotated at relatively high speeds. After articles disposed in wash basket 120 are cleaned and/or washed, the user can remove the articles from wash basket 120, e.g., by reaching into wash chamber 121 through aperture 118.

The wash tub 124 is configured for containing fluid, e.g., wash and rinse fluids, during operation of washing machine appliance 100 described above. Wash fluid generally includes water mixed with fluid additives, e.g., detergent, fabric softener, and/or bleach. As used herein, the terms "additive" or "fluid additive" generally refer to fluids other than water, such as detergent, bleach, fabric softener and/or other such laundry treatment chemicals. Wash and rinse fluids disposed within the wash tub 124 can be used to clean articles disposed in wash basket 120. Wash and rinse fluids can pass between wash basket 120 and the wash tub 124 through a plurality of apertures 140 defined by wash basket 120, e.g., during the wash and/or spin cycles described above.

As may be seen in FIG. 3, the washing machine appliance 100 may include a lock 200 and a light 210 positioned within the cabinet 102. As is generally understood by those of skill in the art, the lock 200 may be configured to engage the door 130, e.g., when the door 130 is in the closed position and the lock 200 is in a locked position, and to thereby prevent the door 130 from rotating away from the closed position to the open position. In other words, the lock 200 may lock the door 130 in the closed position. For example, the lock 200 may include a recess 204 (FIG. 6) and the door 130 may include a striker (not shown) which extends into the recess 204 of the lock 200 when the door 130 is in the closed position to engage with the lock 200 and thereby secure the door 130 in the closed position. In additional embodiments, the relative positions of the interlocking features on the door 130 and the lock 200 may be reversed, for example, a feature on the door 130, such as a loop or cavity, may be engaged by a moving part of the lock 200, such as a bolt, where the bolt moves into the loop or cavity feature on the door 130 to secure the door 130 in the closed position. The lock 200 may be an electronically actuated lock, e.g., the lock 200 may be connected to a power supply and to the controller 192 of the washing machine appliance 100, e.g., via an electrical cable 201 (FIG. 3) comprising a plurality of wires. Thus, the lock 200 may be actuated by the controller 192 to move the lock 200, e.g., a bolt thereof, from the unlocked position to the locked position and vice versa, e.g., into and out of engagement with the striker on the door 130. In some embodiments, where the power supply is an alternating current (AC) power supply, the lock 200 may include a converter to provide direct current (DC) power to the light 210, e.g., when the light 210 is or includes a light-emitting diode (LED).

Figure 4:
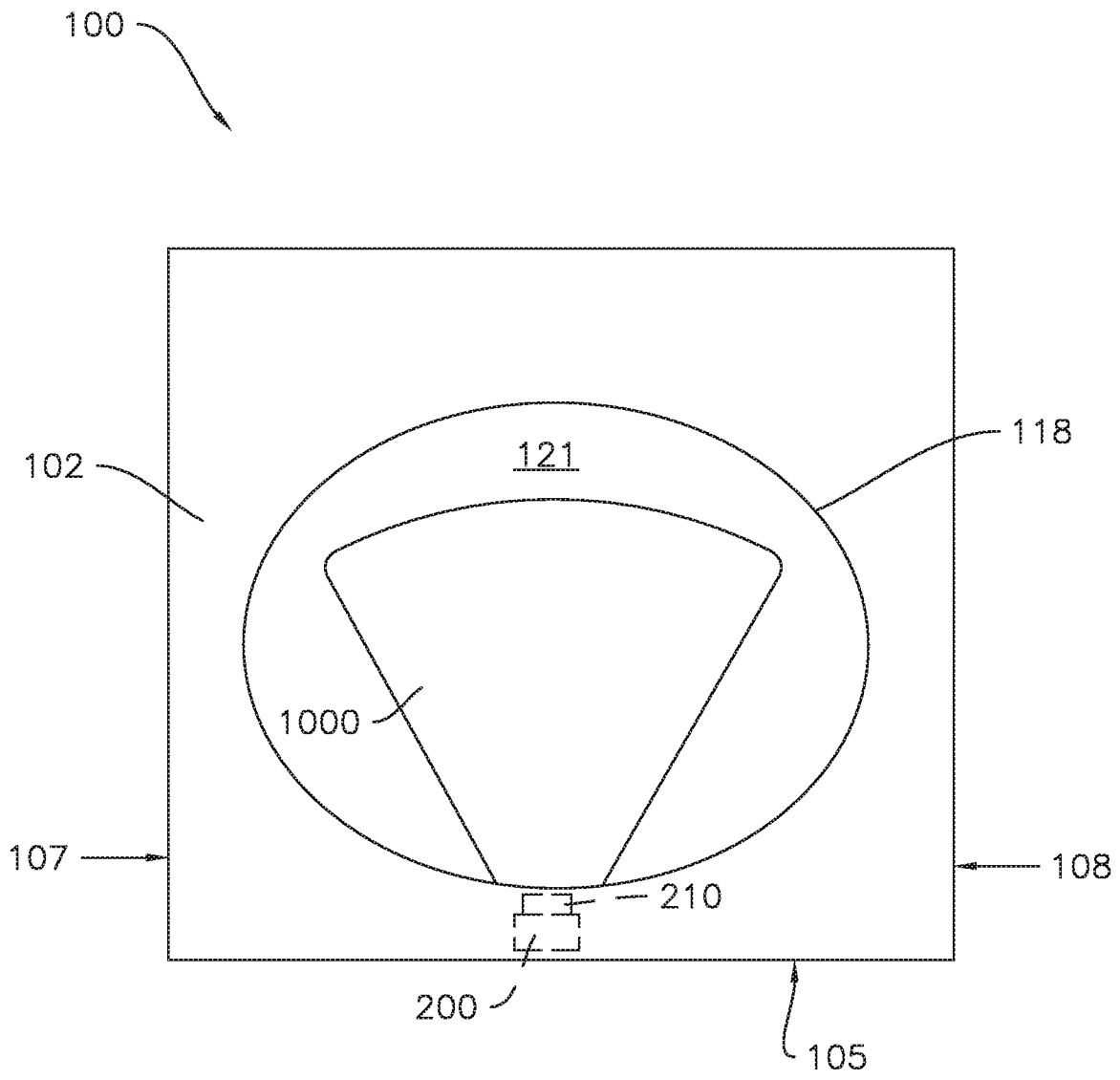
FIG. 4 provides a schematic illustration of a washing machine appliance such as the exemplary washing machine appliance of FIG. 1 including a lid lock and light assembly according to one or more exemplary embodiments of the present disclosure.
Figure 5:
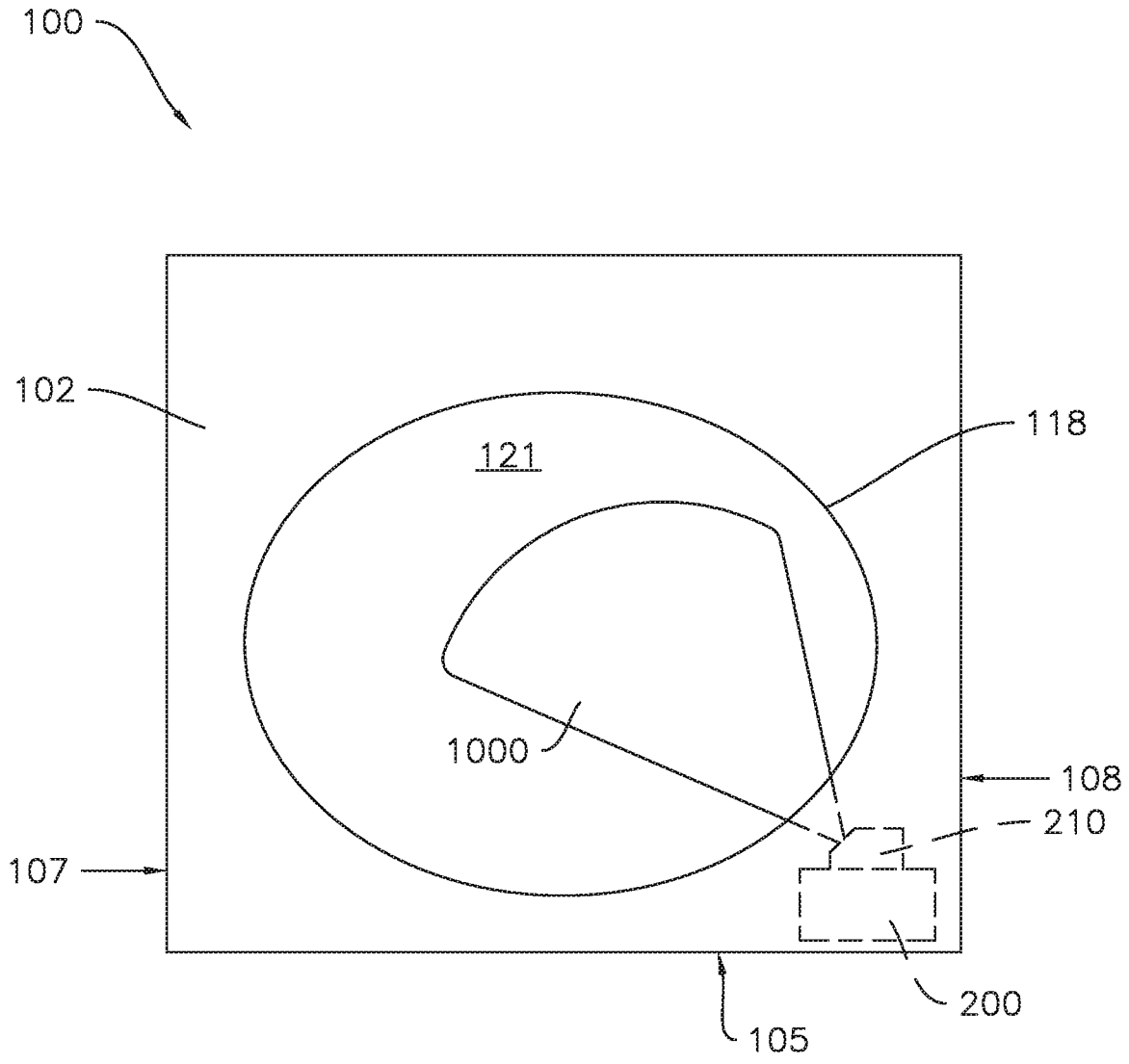
FIG. 5 provides a schematic illustration of a washing machine appliance such as the exemplary washing machine appliance of FIG. 1 including a lid lock and light assembly according to one or more additional exemplary embodiments of the present disclosure.

As generally illustrated in FIGS. 4 and 5, the light 210 may be configured, e.g., positioned and oriented, to illuminate the wash chamber 121. As illustrated, the light 210 may be positioned at or near the front side 105 of the cabinet 102. In some embodiments, e.g., as shown in FIG. 4, the light 210 may be positioned at or around a lateral center of the front side 105 of the cabinet 102. In other embodiments, e.g., as shown in FIG. 5, the light 210 may be positioned at or around a front corner of the cabinet 102, such as a front right corner, e.g., a corner of the cabinet 102 defined by the intersection of the front side 105 and the right side 108.

Figure 6:
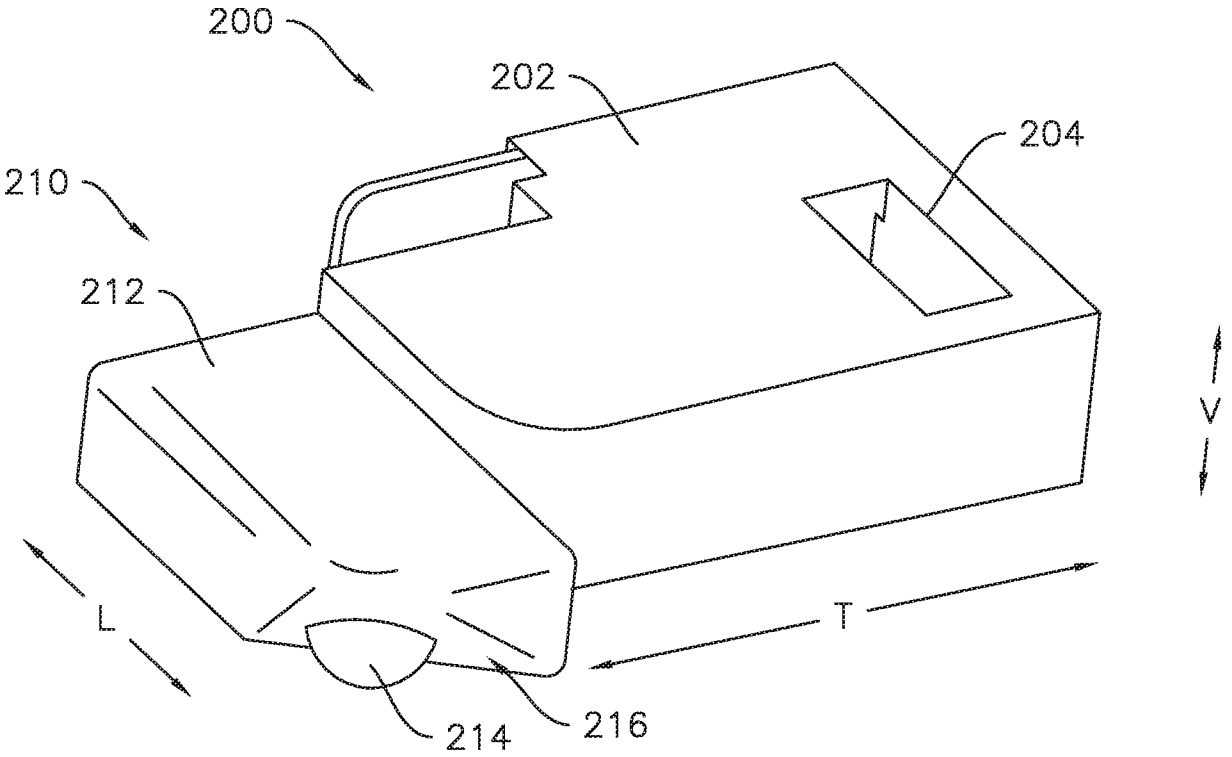
FIG. 6 provides a perspective view of a lid lock and light assembly according to one or more exemplary embodiments of the present disclosure.

As may be seen in the FIG. 6, the light 210 may be mounted to the lock 200. For example, in some embodiments, the light 210 and the lock 200 may be integrally formed as a unitary body. As another example, in other embodiments, the light 210 may be removably mounted on the lock 200, such as the light 210 may be plugged into the lock 200. For example, the light 210 may include a plug (not shown) and the lock 200 may include a socket (not shown) which receives the plug of the light 210, whereby the light 210 may be plugged into the lock 200. As another example, the relative positions of the plug and socket may be reversed. The structure and function of electrical plugs and corresponding sockets are well understood by those of ordinary skill in the art and, as such, are not shown or described in further detail for the sake of clarity and brevity.

As mentioned above, the lock 200 may be configured to engage a striker of the door 130. As illustrated in FIG. 6, the lock 200 may include a main body 202 having a recess 204 therein. The striker (not shown) of the door 130 may be received within the recess 204 of the lock 200 when the door 130 is in the closed position. Thus, when the door 130 is in the closed position, the lock 200 may be moved, e.g., actuated, to the locked position to engage the striker of the door 130 and thereby lock the door 130 in the closed position.

Figure 7:
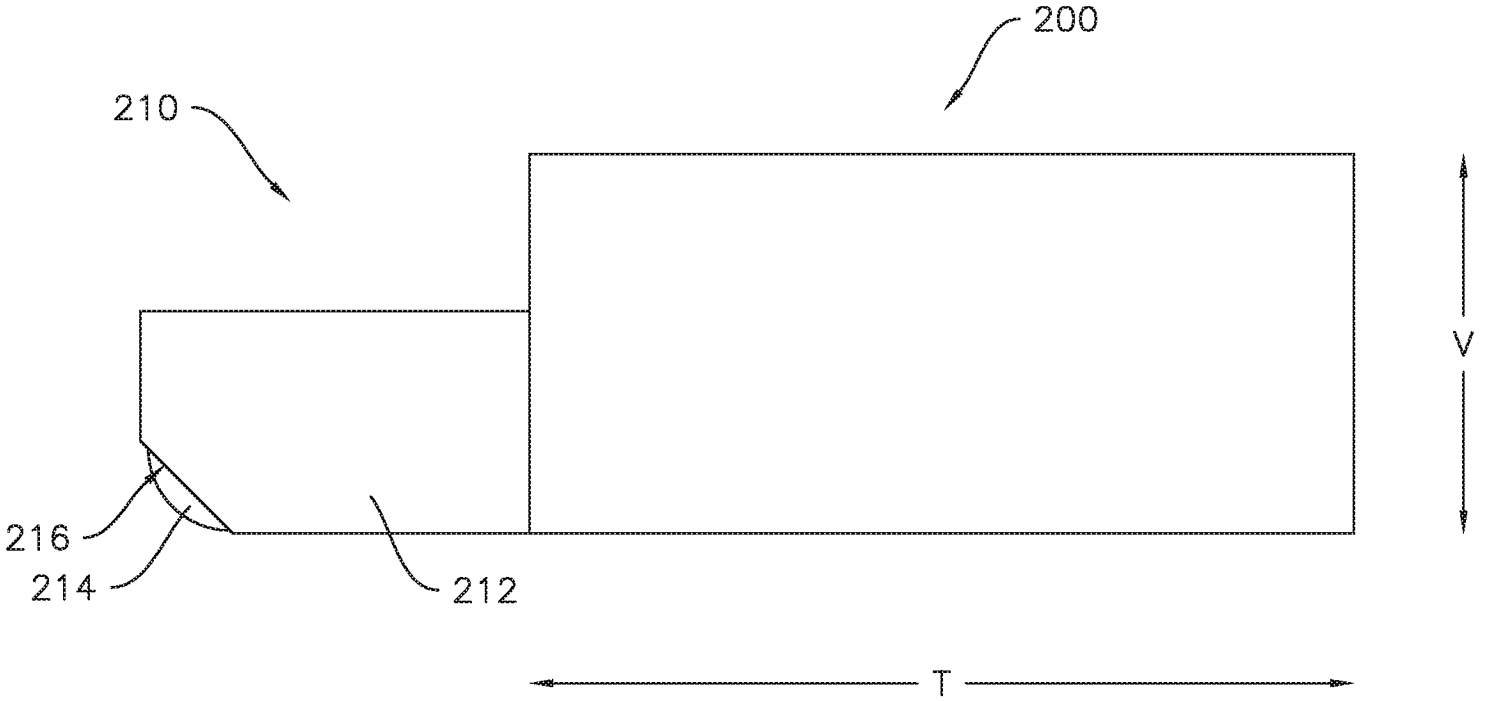
FIG. 7 provides a side view of a lid lock and light assembly according to one or more additional exemplary embodiments of the present disclosure.
Figure 8:
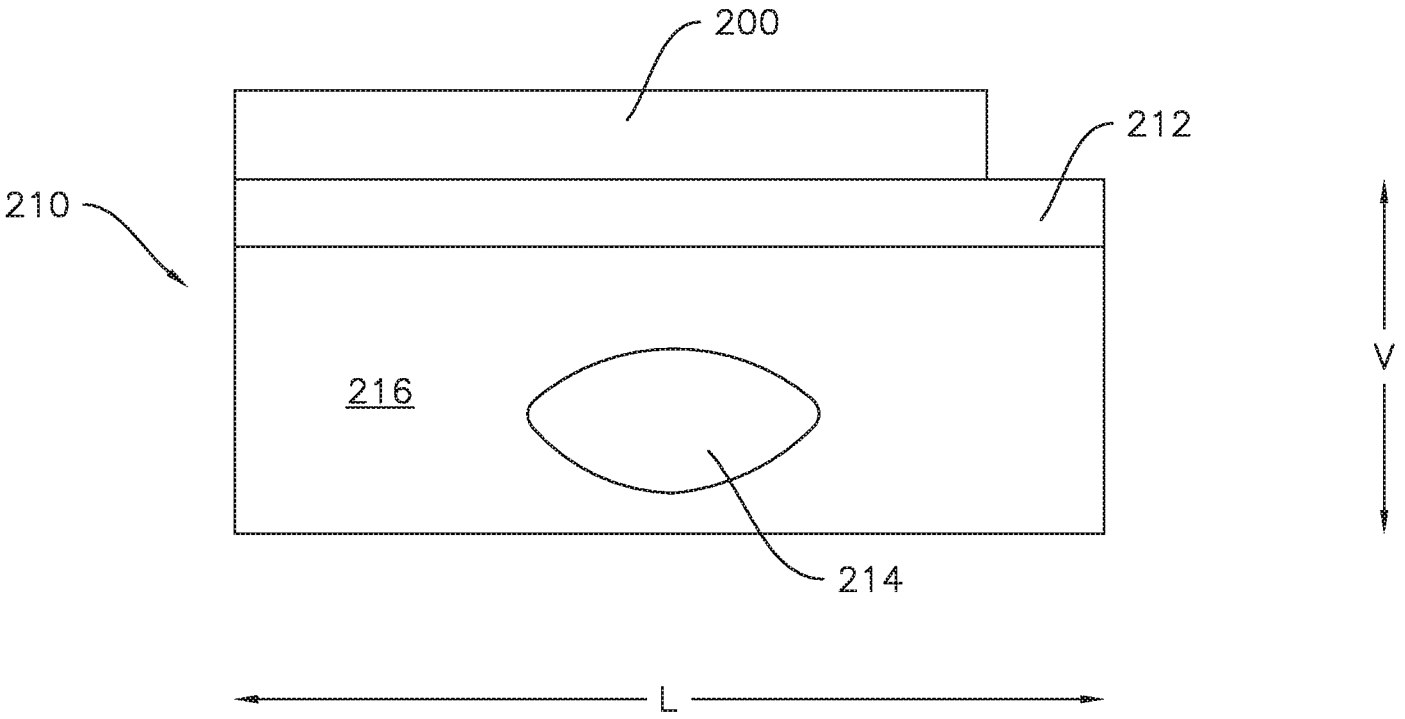
FIG. 8 provides a front view of a lid lock and light assembly of FIG. 7.

As may be seen in FIGS. 6 through 8, the light 210 may include a housing 212 and a lens 214 on an oblique face 216 of the housing 212. It should be understood that the lens 214 may be translucent or transparent and may be provided in any suitable color (e.g., in embodiments where the lens 214 is translucent) or no color at all (e.g., in embodiments where the lens 214 is transparent, the lens 214 may be clear). For example, the lens 214 may be translucent white, blue, or green, etc. In some embodiments where the light 210 is removably mounted on the lock 200, e.g., the plug-in light 210 as described above, multiple lights 200 with lenses 214 of different colors may be interchangeable.

In some embodiments, the lens 214 may be provided as a dome, such as a portion of a sphere, as illustrated in FIGS. 6 through 8. In other embodiments, the lens 214 may be flat or aspherical and may be convex or concave. Additionally, those of ordinary skill in the art will recognize that a light source of the light 210 may be positioned inside the housing 212 proximate the lens 214 and in optical communication with the lens 214 to form a light beam 1000 (FIGS. 4 and 5) within the wash chamber 121. The light source may be, for example, a light-emitting diode (LED), or a light bulb, etc. Such light sources are readily understood by those of ordinary skill in the art and, as such, are not illustrated or described in further detail herein.

In various embodiments, the oblique face 216 of the light 210 may be oblique to at least two of the vertical direction V, the lateral direction L, and the transverse direction T. For example, in embodiments such as the example embodiment illustrated in FIG. 6, the oblique face 216 may be defined at a corner of the housing 212 and may be oblique to each of the vertical direction V, the lateral direction L, and the transverse direction T. As another example, in embodiments such as the example embodiment illustrated in FIGS. 7 and 8, the oblique face 216 may be oblique to the vertical direction V and the transverse direction T (as best seen in FIG. 7). In such embodiments, the housing 210 may define a width along the lateral direction L and the oblique face 216 may be aligned along the lateral width of the housing 212. For example, as illustrated in FIG. 8, the oblique face 216 may extend across the lateral width of the housing 212, such as fully across the lateral width of the housing 212 from end to end.

As mentioned above, the lock 200 may be connected to an electrical cable 201 comprising a plurality of wires. In some embodiments, the electrical cable 201 may be a single electrical cable 201 connected to both the lock 200 and the light 210. For example, the single electrical cable 201, and the plurality of wires thereof, may be the sole and only electrical connection for both the lock 200 and the light 210. Thus, the light 210 may be advantageously provided or added to the washing appliance 100 without requiring a separate or dedicated electrical cable or other connection. In some embodiments, the light 210 may be controlled in such a manner as to be dependent on the door 130 lock status so that no additional wiring would be required, e.g., where the light 210 is wired in series with the lock 200, without requiring or including a dedicated wire in the electrical cable 201 for the light 210. For example, the light 210 may be configured to illuminate when the lock 200 is energized, such as the light 210 may be always on whenever the lock 200 is unlocked. As another example, when the striker goes from present to not present (e.g., when the door 130 is unlocked and/or opened) the light 210 may come on for a predetermined period of time. In other embodiments, one wire of the plurality of wires in the electrical cable 201 may be directly connected to the light 210 or otherwise provide a dedicated connection for the light 210, whereby the light 210 may be operated, e.g., by the controller 192, separately and independently of the status (e.g., locked or unlocked) of the lock 200. Additionally, in some embodiments, the light 210 may also or instead be configured to illuminate for a predetermined amount of time when the lock 200 senses that the door has been closed or opened. In additional embodiments, the light 210 may also or instead be configured to illuminate in response to a manual user input, e.g., when a button on the control panel 110 is pushed, to turn on the light 210.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A washing machine appliance comprising:

a cabinet defining a vertical direction, a lateral direction, and a transverse direction, the vertical direction, the lateral direction, and the transverse direction being mutually perpendicular;

a tub positioned within the cabinet;

a basket rotatably mounted within the tub, the basket defining a wash chamber for receipt of articles for washing, the basket positioned proximate an aperture in the cabinet whereby the wash chamber is accessible through the aperture;

a door rotatably mounted to the cabinet, the door selectively rotatably between a closed position where the door inhibits access to the wash chamber and an open position which permits access to the wash chamber through the aperture;

a lock configured to engage the door and prevent the door from rotating to the open position when the door is in the closed position and the lock is in a locked position; and a light mounted to the lock, the light comprising a housing and a lens on an oblique face of the housing, the lens positioned and oriented to illuminate the wash chamber, wherein the oblique face of the housing is oblique to at least two of the vertical direction, the lateral direction, and the transverse direction, wherein the light is positioned at a corner of the cabinet.

2. The washing machine appliance of claim 1, wherein the oblique face of the housing is defined at a corner of the housing.

3. The washing machine appliance of claim 1, wherein the oblique face of the housing extends across a width of the housing.

4. The washing machine appliance of claim 1, further comprising a single electrical cable connected to both the lock and the light.

5. The washing machine appliance of claim 1, wherein the light and the lock are integrally formed as a unitary body.

6. The washing machine appliance of claim 1, wherein the light is removably mounted on the lock via a plug on one of the lock and the light and a socket in the other of the lock and the light.

7. A washing machine appliance comprising:

a cabinet;

a tub positioned within the cabinet;

a basket rotatably mounted within the tub, the basket defining a wash chamber for receipt of articles for washing, the basket positioned proximate an aperture in the cabinet whereby the wash chamber is accessible through the aperture;

a door rotatably mounted to the cabinet, the door selectively rotatably between a closed position where the door inhibits access to the wash chamber and an open position which permits access to the wash chamber through the aperture;

a lock configured to engage the door and prevent the door from rotating to the open position when the door is in the closed position and the lock is in a locked position; and a light mounted to the lock, the light positioned and oriented to illuminate the wash chamber, wherein the light is positioned at a corner of the cabinet.

8. The washing machine appliance of claim 7, wherein the lock and the light are wired in series such that the light illuminates when the lock is in an unlocked position.

9. The washing machine appliance of claim 7, wherein the light is configured to illuminate for a predetermined period of time when the lock moves from the locked position to an unlocked position.

10. The washing machine appliance of claim 7, wherein the light is configured to illuminate independently of the lock.

11. The washing machine appliance of claim 7, further comprising a single electrical cable connected to both the lock and the light.

12. The washing machine appliance of claim 7, wherein the light and the lock are integrally formed as a unitary body.

13. The washing machine appliance of claim 7, wherein the light is removably mounted on the lock via a plug on one of the lock and the light and a socket in the other of the lock and the light.

14. The washing machine appliance of claim 7, wherein the cabinet defines a vertical direction, a lateral direction, and a transverse direction, the vertical direction, the lateral direction, and the transverse direction being mutually perpendicular, and wherein the light comprises a housing and a lens on an oblique face of the housing.

15. The washing machine appliance of claim 14, wherein the oblique face of the housing is defined at a corner of the housing.

16. The washing machine appliance of claim 14, wherein the oblique face of the housing extends across a width of the housing.

17. The washing machine appliance of claim 14, wherein the oblique face of the housing is oblique to at least two of the vertical direction, the lateral direction, and the transverse direction.

18. The washing machine appliance of claim 14, wherein the oblique face of the housing is oblique to each of the vertical direction, the lateral direction, and the transverse direction.

* * * * *